United States Patent [19]

Owens

[11] Patent Number: 4,807,324

[45] Date of Patent: Feb. 28, 1989

[54] TWO COLOR DEPTH TINTING APPARATUS

[76] Inventor: Edward C. Owens, 1061 Gorman Ave., W. St. Paul, Minn. 55118

[21] Appl. No.: 45,298

[22] Filed: May 1, 1987

[51] Int. Cl.[4] ..... A46B 15/00

[52] U.S. Cl. ..... 15/166; 15/160; 15/DIG. 5

[58] Field of Search ..... 15/160, 166, 106, DIG. 5, 15/201, 202; 132/7

[56] References Cited

U.S. PATENT DOCUMENTS

| | | | |
|---|---|---|---|
| 655,833 | 8/1900 | Roth | 15/201 |
| 857,239 | 6/1907 | Hawkins | 15/166 |
| 2,116,406 | 5/1938 | Nancarrow | 15/166 |
| 4,483,036 | 11/1984 | Sayklay | 15/DIG. 5 X |

FOREIGN PATENT DOCUMENTS

| | | | |
|---|---|---|---|
| 274741 | 5/1930 | Fed. Rep. of Germany | 15/201 |
| 585946 | 10/1933 | Fed. Rep. of Germany | 15/166 |

*Primary Examiner*—Harvey C. Hornsby
*Assistant Examiner*—K. L. O'Leary
*Attorney, Agent, or Firm*—Thomas B. Tate

[57] ABSTRACT

The invention is a system for applying color to hair in such a manner as to show depth of color. The system comprises two application brushes of different lengths which are riveted together, and can be opened to dip into two colors simultaneously, then closed to apply both colors at once to show depth of color in the hair.

1 Claim, 3 Drawing Sheets

TWO COLOR DEPTH TINTING APPARATUS

SUMMARY AND BACKGROUND OF THE INVENTION

Because of the limitations of application brushes currently marketed, hair stylists customarily tint hair by applying one color at a time as an all-over color.

The object of the invention is to enable a hair stylist to apply two colors at once, thereby adding depth to the color and allowing the creation of special effects such as highlights and lowlights. This system can be used to design innovative hair styles which cannot be easily created with current equipment, and it also allows natural hair colors to be more closely approximated where this effect is desired. The invention can also be used for applying color and conditioner, or color and bleach simultaneously, or to color only certain strands of hair.

DESCRIPTION OF THE PREFERRED EMBODIMENT OF THE INVENTION

Figure 1:
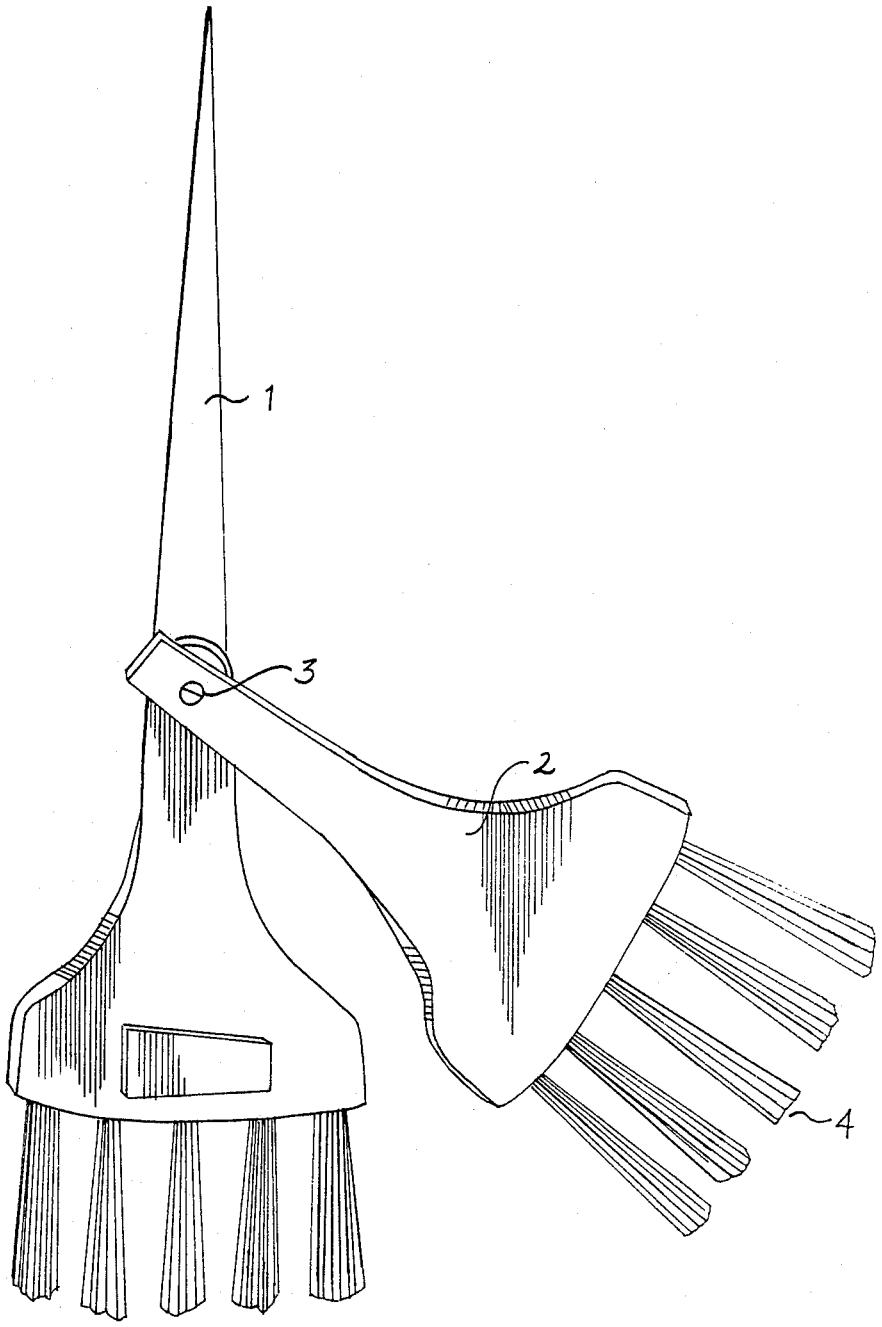
FIG. 1 is a front view of the invention in open position.
Figure 2:
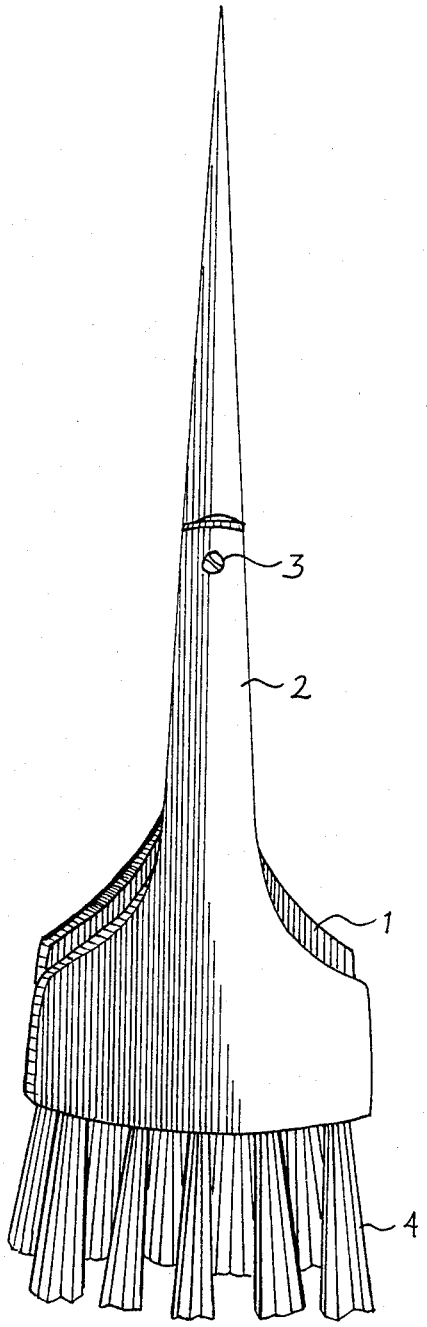
FIG. 2 is a front view of the invention in closed position.
Figure 3:
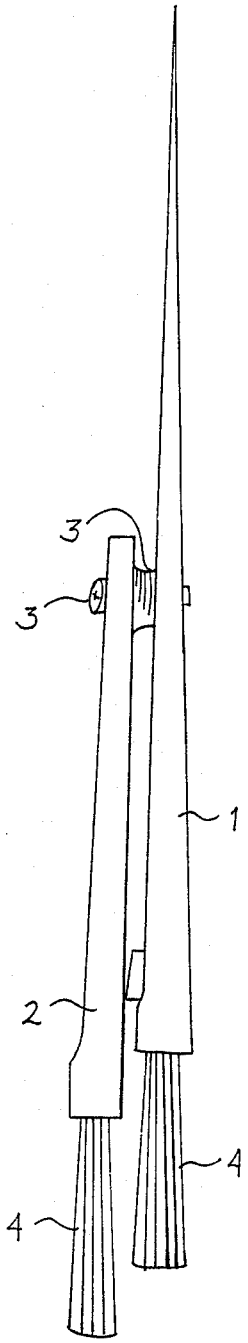
FIG. 3 is a side view.

The invention comprises two tint-application brushes, preferably made of plastic. Brush 1 is six to eight inches long and brush 2 is three to five inches long. Brushes 1 and 2 are attached to each other by means of a rivet 3 positioned two and one-half to three inches from the bristle end of brush 1, the rivet 3 providing a spacing of three-sixteenths of an inch between brushes 1 and 2. The bristles 4 are one and one-fourth inches long and are spaced every one-half inch alternating on either brush, thus providing the appearance of laid bricks as seen from an end view. The brushes and bristles are offset one-fourth of an inch from front to back to correspond to the average angle of the cranium bone (thirty to forty degrees).

Brush 2 pivots on the rivet 3 so that it can be opened to form an angle with brush 1 up to approximately forty-five degrees, and it can be closed again to align in a straight line with brush 1. The opening and closing of the brushes can be accomplished easily using one hand.

To use the invention, two bowls, each containing a different color, or a divided bowl containing two different colors, are prepared. The brushes, in the open position, are dipped into each color simultaneously. The brushes are then adjusted to the closed, straight line position and both colors are applied to the hair. Because of the one-fourth inch offset of the brushes to conform to the angle of the cranium, first the lower brush 1 and then the upper brush 2 contacts the hair. The effect of this method of applying tint is to add depth to the color.

Optional features include stops (of the pin or nail type inserted into two holes in the brush) in order to make the brushes interchangeable for right-handed or left-handed people, and a spring-return to open and close the brushes.

It should also be understood that the dimensions recited above are approximate and are included solely to illustrate the proportions of the various components of the invention. It is intended that the scope of the invention include all variations which do not depart from the spirit of the invention.

I claim:

1. A device for adding depth to tinted hair by applying two colors at once, said device comprising:

a first brush having a handle with bristles extending forwardly from one end thereof;

a second brush also having a handle with bristles extending forwardly from one end thereof, said second brush handle being shorter than said first brush handle;

rivet means fastening said handle of said second brush to said handle of said first brush in spaced relation thereto, said rivet means allowing said second brush to pivot partially around the axis formed by said rivet means;

said device having a closed position wherein said second brush is aligned in a vertical line with said first brush, and an open position wherein said second brush is aligned at an acute angle with said first brush;

said bristles of said first brush and said second brush being spaced alternately on said brushes;

said bristles of said second brush and said first brush being vertically offset such that in the closed position the bristles of the first brush are spaced at an elevation above the bristles of the second brush.

* * * * *